United States Patent [19]

Darner

[11] Patent Number: 4,785,866

[45] Date of Patent: Nov. 22, 1988

[54] TRAVERSE ROD AND SUPPORT ASSEMBLY

[75] Inventor: Ronald G. Darner, Fort Atkinson, Wis.

[73] Assignee: Graber Industries, Inc., Middleton, Wis.

[21] Appl. No.: 943,378

[22] Filed: Dec. 16, 1986

[51] Int. Cl.[4] ..... A47H 5/02

[52] U.S. Cl. ..... 160/345; 160/126

[58] Field of Search ..... 160/345, 346, 347, 123, 160/124, 125, 126, 330; 16/87.4 R, 87.6 R, 94 D, 95 D, 96 D

[56] References Cited

U.S. PATENT DOCUMENTS

| | | | |
|---|---|---|---|
| 2,863,505 | 12/1958 | Cameron | 160/345 |
| 3,049,176 | 8/1962 | Graber et al. | 160/346 |
| 3,514,806 | 6/1970 | Klein | 160/345 X |
| 3,693,696 | 9/1972 | Salzmann | 16/87.4 R X |
| 3,951,197 | 4/1976 | Cohen et al. | 16/87.6 R X |
| 3,992,750 | 11/1976 | Ford et al. | 16/95 D |
| 4,068,345 | 1/1978 | Hehl et al. | 16/87.4 R X |
| 4,276,920 | 7/1981 | Comeau | 160/345 |
| 4,402,109 | 9/1983 | Ohman et al. | 16/95 D |

*Primary Examiner*—Robert W. Gibson, Jr.
*Assistant Examiner*—David M. Purol
*Attorney, Agent, or Firm*—Vernon J. Pillote

[57] ABSTRACT

A drapery traverse rod and support assembly including a pulley housing at each end of the rod and a mounting bracket for mounting the pulley housing on a supporting surface. The pulley housing has a bottom wall, upstanding inner and side walls and a front wall and a rod engaging portion for supporting an end of a traverse rod with the rod extending transverse to the inner side wall of the pulley housing adjacent the front wall. The mounting bracket has a rear mounting pad portion and pulley housing support arms extend forwardly from the mounting pad portion and into the pulley housing. The pulley housing support arms have cord guides adapted to guide traverse cords from the end of the rod rearwardly toward the wall, and the mounting bracket has cord guides adapted to guide traverse cords downwardly adjacent the rear mounting pad portion of the mounting bracket. A pulley housing cover is detachably mounted on the pulley housing to cover the pulley housing cord guides and a mounting bracket cover is detachably mounted on the mounting bracket to cover the mounting bracket cord guides. A latch plate is mounted on the mounting bracket and arranged to engage the pulley housing to releasably latch the pulley housing in different adjusted positions on the mounting bracket.

17 Claims, 3 Drawing Sheets

Fig. 9.
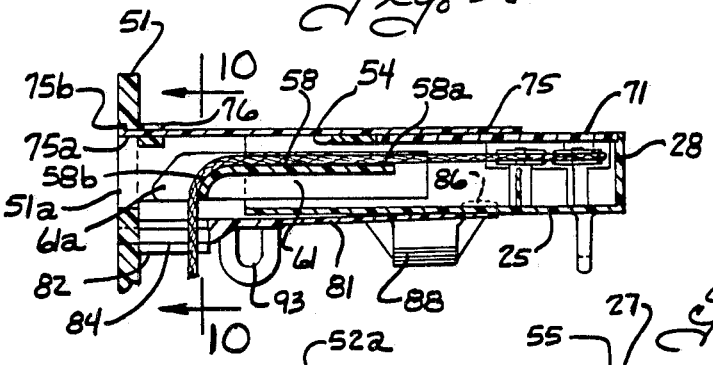
Fig. 11b.
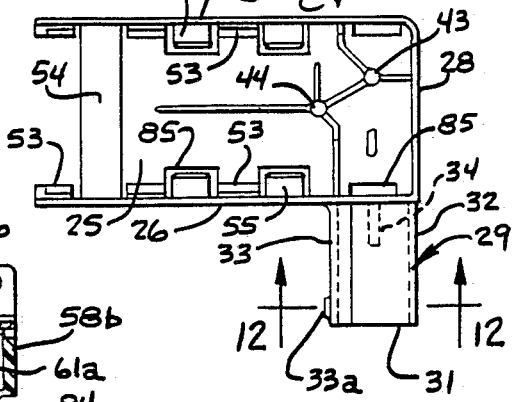
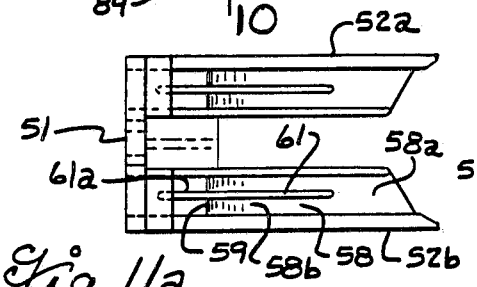
Fig. 11a.
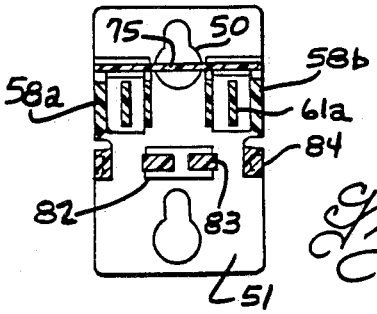
Fig. 10.
Fig. 12.
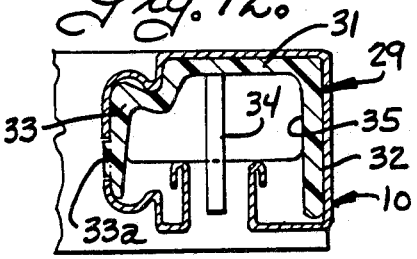
Fig. 8.
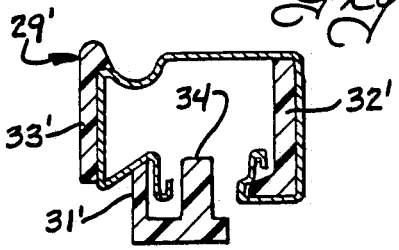

TRAVERSE ROD AND SUPPORT ASSEMBLY

BACKGROUND OF THE INVENTION

In drapery traverse rods, it is common practice to provide a pulley housing at each end of the rod and to mount the pulley housing on an adjustable wall mounting bracket, for example as disclosed in U.S. Pat. No. 3,049,176. In traverse rods of the type disclosed in that patent, cord guide pulleys in te pulley housing at one end of the rod are arranged to guide the traverse cord into and out of the end of the rod while the cord guide pulleys in the pulley housing at the other end of the rod are arranged to guide the traverse cords downwardly from the end of the rod to provide two downwardly extending traverse cord operating portions at the end of the rod which can either be separate or interconnected in a continuous loop. The traverse cord is operated by pulling on one or the other of the operating portions of the traverse cord and, when the cords extend downwardly from adjacent the ends of the rod, the downward pull on the operating portions of the cord exerts a bending moment on the mounting brackets that increases with increases in spacing of the traverse rod from the support wall.

It has heretofore been proposed as disclosed in U.S. Pat. No. 4,276,920, to provide a traverse rod with pulley housings at opposite ends of the rod and with the pulleys in at least one pulley housing arranged to guide the traverse cords from the end of the traverse rod rearwardly toward the wall, and to provide a wall pulley bracket and wall pulleys for guiding the traverse cords downwardly so that the operating portions of the traverse cords are adjacent the wall. In the traverse rod assembly disclosed in this patent, the traverse rod is supported by mounting brackets separate from the pulley housing and the pulley housing is merely spaced from the wall pulley bracket by a spacer piece that extends between the pulley housing and the wall pulley bracket. While this arrangement reduces the bending loads on the traverse rod mounting brackets due to the downward pull exerted on the traverse cords, it requires the provision of traverse rod mounting brackets that are separate from the pulley housing and wall pulley bracket. In addition, the wall pulley brackets and wall pulleys and the portions of the traverse cords that extend between the wall pulleys and the pulley housing were not enclosed and accordingly remained exposed to view and to air-borne dust and dirt.

SUMMARY OF THE INVENTION

It is an object of the present invention to provide a traverse rod and support assembly having pulley housings at the end of the rod and wall mounting brackets for mounting the pulley housings on a support surface, and in which at least one of the pulley housings has cord guide means to guide the traverse cord rearwardly toward the wall and in which at least one pulley housing mounting bracket has second cord guide means for guiding the traverse cord downwardly adjacent the wall to thereby reduce the bending loads on the pulley housing and mounting bracket.

Another object of this invention is to provide a traverse rod and support assembly in accordance with the foregoing object, and in which the pulley housing and mounting bracket are arranged to substantially enclose the cord guides and the horizontally extending portions of the cords that extend between the guides to provide a neat appearance and protect the operating parts from contamination by dust and the like.

Still another object of the present invention is to provide a traverse rod and support assembly in accordance with the foregoing objects and in which the pulley housing and mounting brackets have removable covers to facilitate threading of the traverse cords over the pulley housing cord guides and the mounting bracket cord guides.

Still another object of this invention is to provide a traverse rod and support assembly having pulley housings at opposite ends of the traverse rod and mounting brackets adjustably connected to the pulley housing and in which positioning the pulley housing can be adjusted on the mounting brackets to change the spacing between the traverse rod and the support wall, without use of tools.

Still another object of this invention is to provide a traverse rod and support assembly in accordance with the foregoing objects and which minimizes the number of different parts that must be made.

The present invention relates to a traverse rod of the type having a lengthwise extending trackway, a master carrier mounted for movement along the trackway, a traverse cord for moving the master carrier, a pulley housing at each end of the rod and a mounting bracket individual to each pulley housing. In accordance with the present invention, each pulley housing is formed with a bottom w all and inner and outer side walls and a front wall and each pulley housing has an open area at the top side and an open area at a rear side and a rod engagside ing means for supporting an end of the traverse rod with the traverse rod extending transverse to the inner side wall of the pulley housing adjacent the front wall of the latter. Each mounting bracket includes a rear mounting pad portion adapted for attachment to a supporting surface and pulley housing support arm means extending forwardly from the mounting pad portion and into the pulley housing through the open rear side of the latter, and means guidably mounting each pulley housing on the support arm means of the associated mounting bracket for adjustment therealong. A first cord guide means is provided on at least one of the pulley housings for guiding the cord from the end of the rod rearwardly toward the wall and a second cord guide means is provided on at least one of the mounting brackets for guiding the cords downwardly alongside the wall. A pulley housing cover is detachably mounted on the pulley housing and overlies the first cord guide means in the pulley housing, and a mounting bracket cover means is detachably mounted on the mounting bracket and overlies the second cord guide means on the mounting bracket.

In accordance with another aspect of the present invention, a latch plate is mounted at one end on the mounting bracket and extends forwardly in underlying relation to the support arm on the mounting bracket and underlies at least a portion of the bottom wall of the pulley housing, and interengaging means are provided on the latch plate and the pulley housing for releasably latching the pulley housing in different adjusted positions on the support arm of the mounting bracket.

BRIEF DESCRIPTION OF THE DRAWINGS

FIG. 8 is a transverse sectional view taken on the plane 8—8 of FIG. 2 and illustrating parts on a larger scale than FIG. 2;

FIG. 9 is a sectional view taken on the plane 9—9 of FIG. 2;

FIG. 10 is a transverse sectional view taken on the plane 10—10 of FIG. 9;

FIGS. 11*a* and 11 b are plan views of a mounting bracket and pulley housing respectively; and FIG. 12 is a transverse sectional view taken on the plane 12—12 of FIG. 11*b* and illustrating parts on a larger scale than FIG. 11*b*.

DETAILED DESCRIPTION

Figure 1:
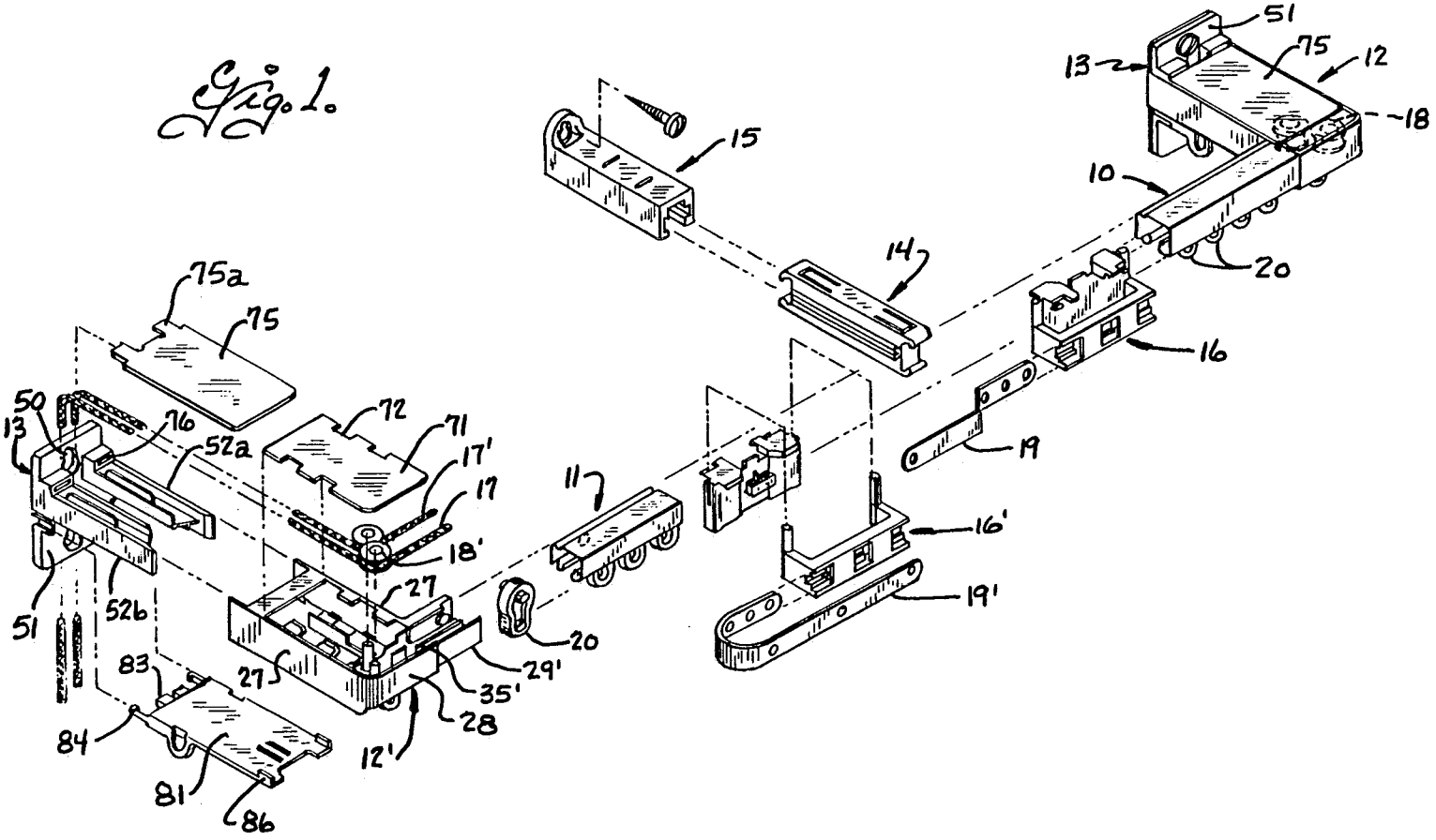
FIG. 1 is perspective view of a traverse rod assembly embodying the pesent invention.

Reference is now made more specifically to FIG. 1 of the drawings wherein there is illustrated a traverse rod assembly embodying the present invention. In general, the traverse rod assembly includes a traverse rod preferably of the adjustable type including an outer rod 10 and an inner rod 11 telescopically receivable in the outer rod. Right and left pulley housings 12 and 12′ are provided at opposite ends of the traverse rod and the pulley housings are supported on mounting brackets 13 adapted for attachment to a supporting surface such as a wall, window casing or the like. One or more intermediate rod engaging brackets 14 are provided for engaging the rod assembly intermediate its end and the intermediate rod engaging bracket is mounted on an intermediate support bracket 15 adapted for attachment to a supporting surface. Master carriers 16, 16′ are mounted for movement along the rod and the master carriers are operated by traverse cords having runs 17, 17′ extending lengthwise of the rod assembly and entrained over cord guides 18, 18′ in the pulley housings 12 and 12′ respectively. The traverse cords are operatively connected to the master carriers to effect movement of the master carriers along the rod and the master carriers 16 and 16′ have drapery support arms 19, 19′ for supporting drapery panels adjacent their lead edge. A plurality of auxiliary drapery carriers 20 are also mounted in the rod assembly to support the drapery panels at locations intermediate the master carrier and the pulley housings at the end of the rod assembly. The telescoping rods 10 and 11 are preferably of the type having a downwardly opening slot in the bottom at a location intermediate the front and rear sides of the rod, as shown in FIGS. 1, 8 and 12.

The right and left pulley housings 12, 12′ are of like construction but are substantially mirror images of each other and arranged for mounting on the right and left ends respectively of the outer and inner traverse rods 10 and 11, and like numerals are used to designate corresponding parts. The pulley housings 12 and 12′ each include a bottom wall 25, inner and outer side walls 26 and 27 that extend upwardly from opposite edges of the bottom wall, and a front wall 28 that extends upwardly at the forward edge of the bottom wall. The pulley housings have an open area at the top side and an open area at the rear side and a rod engaging means 29 for supporting an end of the traverse rod with the traverse rod extending transverse to the inner side wall of the pulley housing adjacent the front wall of the latter. The rod engaging means 29 on the right pulley housing 12 is arranged to engage the outer rod section as shown in FIGS. 1 and 12 and the rod engaging means 29′ on the other pulley housing 12′ is arranged to engage the inner rod section as shown in FIGS. 1 and 8. As best shown in FIG. 12, the rod engaging means 29 on the pulley housing 12 has a downwardly opening generally U-shaped configuration and includes a top wall 31, a depending front wall 32, and a rear wall 33 shaped to extend along the inner sides of the respective top front and rear walls of the outer rod section 10. A protrusion 33*a* is provided on the rear wall and arranged to extend into an opening in the rear wall of the rod section 10 to retain the rod section on the rod engaging means 29. The pulley housing is conveniently formed by molding of a suitable rigid plastic and the rod engaging means is formed integrally with the inner side wall 26. The side wall 26 has an opening 35 formed therethrough to allow cords to pass from the outer rod section into the pulley housing, and a slide stop 34 is integrally joined with the top wall 31 and side wall 26 and extends crosswise of the opening 35 at a location substantially medially of the slot in the outer rod. The rod engaging means 29′ on the pulley housing 12′ differs somewhat in configuration from the rod engaging means 29 on pulley housing 12 and like numerals followed by the postscript are used to designate corresponding parts. The rod engaging means 29′ on the other pulley housing 12′ includes a front wall 32′ arranged to extend along the inner side of the front wall of the inner rod; a rear wall 33′ arranged to extend along the outer side of the rear wall of the inner rod, and a support wall 31′ arranged to engage the outer side of the inner rod at the bottom thereof, as best shown in FIG. 8. The side wall 26 of the pulley housing 12′ has a notch 35′ (FIGS. 1 and 2) arranged to register with the end of the inner rod to allow passage of cords therethrough, and a slide stop 34′ is formed integrally with the wall portion 31′ at a location substantially medially of the slot in the inner rod 11. A protrusion 33*a*′ (FIG. 2) is provided on the rear wall portion 33′ of the rod engaging means 29′, and adapted to engage an opening in the inner rod to retain the inner rod in assembled relation on the pulley housing 12′.

The cord guides 18, 18′ are preferably in the form of grooved pulleys 41, 42 in each of the pulley housings 12, 12′. The cord guide pulleys 41 and 42 are mounted on upright spindles 43, 44 molded integrally with the bottom wall 25 of the pulley housing and means are provided for underlying and supporting the pulleys at a level spaced above the bottom wall. As best shown in FIG. 9, the pulley housing is formed with a plurality of ribs 46 that extend outwardly from the spindles 43 and 44 and which underlie the pulleys to support the grooved pulleys at a preselected level above the bottom wall, and at least some of the ribs are formed with portions that extend upwardly adjacent the peripheries of the pulleys to aid in retaining the traverse cords on the pulleys. The pulleys 41 and 42 are advantageously arranged in a manner described more fully hereinafter so that the pulleys in either pulley housing can be used to either guide a traverse cord from one end of the rod and back into that end of the rod or to guide the traverse cords horizontally rearwardly toward the wall so that the operating portions of the cord can be located at either the left or the right side of the rod.

The wall mounting brackets 13 for the pulley housings 12 and 12' are preferably of like construction and like numerals are used to designate the same parts. Each wall mounting bracket includes a mounting pad portion 51 adjacent the rear end thereof and pulley housing support means that extends forwardly from the mounting pad portion and which is adapted to extend through the open rear side of the pulley housing. In the preferred embodiment, the pulley housing support means comprises a pair of support arms 52*a*, 52*b* that are substantially mirror images of each other to adapt the same mounting bracket for use supporting the pulley housings on either the left or the right end of the traverse rod. The pulley housings are each guidably mounted on the support arms of the mounting bracket for adjustment therealong. For this purpose, the support arms 52*a* and 52*b* are arranged to be slidably received between the side walls 26 and 27 of the associated pulley housing. Flanges 53 are provided at spaced locations along opposite side edges of the bottom wall and arranged to engage the lower edge of the respective arm 52*a*, 52*b*. A reinforcing cross member 54 extends between the side walls 26 and 27 at a location to overlie the upper edges of the support arms 52*a*, 52*b*, and a plurality of upper flanges 55 are provided at spaced locations along each side wall 26, 27 to overlie and engage the upper edge of the support arms, to thereby guidably mount the pulley housing on the support arms.

The pulley housing support arms are formed with a second cord guide means for guiding a traverse cord from the cord guides of the pulley housing and downwardly through a cord guide opening adjacent the rear mounting pad 51. In the preferred embodiment illustrated, a second cord guide means is provided on each of the arms 52*a* and 52*b* and comprises an open top channel 58 having a forward end 58*a* disposed at a level adjacent the level of the grooved pulleys to receive traverse cords exending rearwardly therefrom, and a rear portion 58*b* that is curved downwardly and rearwardly at a location spaced forwardly from the mounting pad portion 51 as best shown in FIG. 9. The support arms 52*a* and 52*b* are each formed with a downwardly opening cord passage 59 between the mounting pad portion 51 and the downwardly curved bottom wall portion 58*b* of the second cord guide means, to allow the traverse cords to pass downwardly from the mounting bracket adjacent the wall. A divider panel 61 extends upwardly from the bottom of the channel 58 approximately medially between opposite sides thereof to separate the channel into two side-by-side cord receiving grooves, and the divider panel has a portion 61*a* that extends rearwardly and at least part way across the downwardly opening cord passage 59 to maintain the traverse cords separated in the passage 59. As best shown in FIG. 9, the rearwardly extending portion 61*a* of the divider panel 61 is spaced forwardly of the mounting pad 51 a distance approximating the thickness of the draw cords so that a loop of the cord can be threaded downwardly past the end of the divider portion 61*a*. The mounting pad 51 has an opening 51*a* adjacent the end of the divider portion 61*a* to facilitate passage of the cord past the divider. Thus, the draw cords 17, 17' can be connected in a continuous loop and the draw cord can be shifted for drawing from either the left or the right ends of the traverse rod without breaking the draw cord loop or necessitating retying of the draw cords. Fastener receiving openings 50 are provided in the mounting pad portion of each mounting bracket to receive wall mounting fasteners (not shown).

Figure 2:
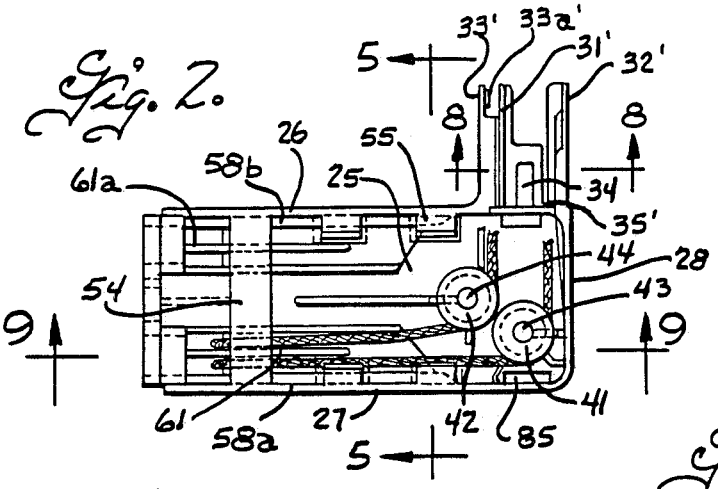
FIG. 2 is a plan view of a pulley housing and mounting bracket shown in assembled condition, and with the covers removed.
Figure 3:
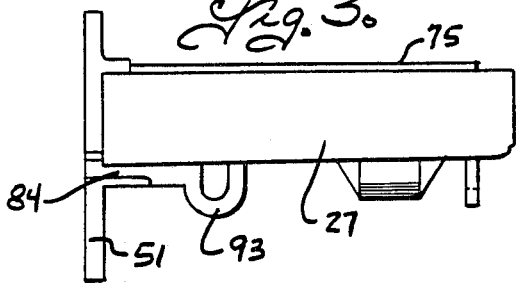
FIG. 3 is a side elevational view of the pulley housing and mounting bracket shown in FIG. 2.
Figure 4:
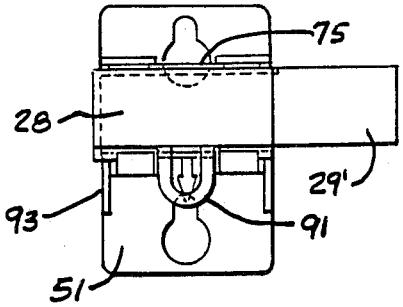
FIG. 4 is an end view of the pulley housing and mounting bracket shown in FIG. 2.

As previously discussed, the pulleys 41 and 42 are arranged in the pulley housing so that the operating portions of the traverse cord can be arranged at either the left or the right hand ends of the rod. For this purpose, the pulleys 41 and 42 are arranged in the pulley housing so that the cord runs 17, 17' from the adjacent end of the rod can either be wrapped about 90° around the pulleys 41 and 42 to extend rearwardly into the second cord guide means on the associated mounting bracket, or, alternatively, the traverse cord can be wrapped in a 180° loop around the pulley 41 so that the pulleys guide the traverse cord to and from the adjacent end of the rod. When the operating portions of the traverse cord are located at the left end of the rod assembly, the rearwardly extending portions of the traverse cord extend through the cord guide channels on one of the arms 52*a* of the left mounting bracket as shown in FIG. 2, and the traverse cord at the other end of the rod is merely looped around the pulley 41. When the operating portions of the traverse cord are located at the right hand end of the rod, the rearwardly extending portions of the traverse cord are guided through the cord guide channel in the support arm 52*b* of the right mounting bracket, and the traverse cord is merely looped around the pulley 41 at the other end of the rod. As best shown in FIG. 2, the pulleys 41 and 42 are of a size and are mounted for rotation about axes such that the peripheries of the pulleys are spaced apart a distance less than the thickness of the traverse cord to vertically confine a traverse cord there- between.

Figure 5:
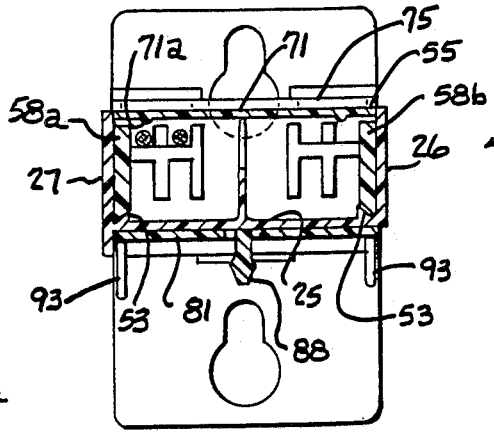
FIG. 5 is a transverse sectional view taken on the plane 5—5 of FIG. 2 and illustrating parts on a larger scale than FIG. 2.
Figure 7:
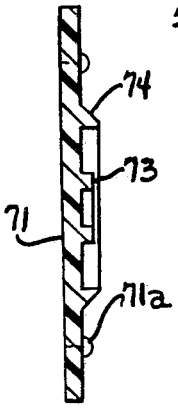
FIG. 7 is a transverse sectional view taken on the plane 7—7 of FIG. 6 and illustrating parts on a larger scale than FIG. 6.
Figure 6:
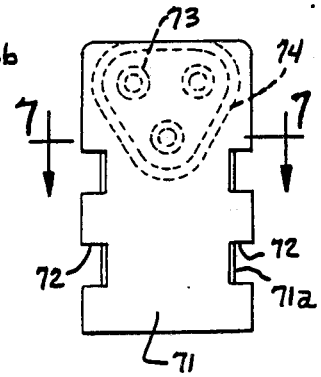
FIG. 6 is a plan view of a pulley housing cover.

The open top of the pulley housing facilitates assembly of the pulleys on the spindles 43, 44 in the pulley housing and also facilitates threading of the traverse cords around the pulleys and into the guide channels on the mounting bracket. A cover 71 is detachably mounted on the pulley housing to overlie the pulleys 41 and 42 and to cover the top of the pulley housing to inhibit entrance of dust and the like. As best shown in FIG. 6, the cover 71 is shaped and dimensioned so as to be receivable between the side walls 26, 27 and the front wall 28 and has notches 72 in each side arranged to register with the upper flanges 55 on the pulley housing. As best shown in FIGS. 5–7, projections 71*a* are provided on the under side of the cover flange at locations adjacent the notches 72 and arranged to engage the underside of the upper flanges 55 on the pulley housing, to detachably retain the cover in position on the pulley housing. The cover is also provided with three bosses 73 arranged in a pattern to register with the spindles 43 and 44 when the cover is mounted on either of the pulley housings 12 of 12'. The bosses are arranged to surround the upper ends of the spindles and retain the pulleys thereon. The cover is also provided with a peripheral depending flange 74 having a generally trilobular configuration and which is arranged to extend downwardly from the cover around the peripheries of the pulleys 41 and 42 when the cover is mounted on either of the pulley housings, to aid in retaining the traverse cords on the pulleys as they pass therearound.

As previously described, the cord guide channels 58 in the mounting bracket are open at the top to facilitate threading of the traverse cords through the cord guide channels and downwardly through the downwardly opening cord guide passage 59. A mounting bracket cover 75 is detachably mounted at its rear end on the mouning pad portion of each mounting bracket to cover the cord guide channels. As best shown in FIGS. 1 and 9, the mounting bracket cover 75 has rearwardly projecting portions 75*a* that extend through openings 76 in the mounting pad portion of the mounting bracket, and detents 75*b* are provided on the rear ends of the portions 75*a* to releasably retain the cover in position. The cover 75 extends forwardly from the mounting pad portion of the mounting bracket in overlying relation to the pulley housing support arms 52*a* and 52*b* and into at least partial overlapping relation with the cover 71 on the pulley housing. With this arrangement, the mounting bracket cover accommodates adjustment of the pulley housing relative to the mounting bracket and provides a cover between the pulley housing and the mounting bracket in the different adjusted positions of the pulley housing.

Provision is made for releasably retaining the pulley housing in different adjusted positions on the mounting bracket. For this purpose, a latch plate 81 is mounted at its rear end on the mounting bracket and the latch plate extends forwardly in underlying relation to the pulley housing support arms 52*a* and 52*b* and into underlying relation with at least a portion of the bottom wall of the pulley housing. As best shown in FIGS. 9 and 10, the mounting pad portion 51 of the mounting bracket is formed with a boss 82 that extends forwardly from the mounting pad portion at a location below and intermediate the downwardly opening cord guide passages 59. The latch plate has portions 83 at its rear end that extend into the boss 82 to support the latch plate in cantilever fashion on the mounting pad portion 51, and the latch plate also has rearwardly extending latch portions 84 that are arranged to engage notches in the mounting pad portion to detachably retain the latch plate in position on the mounting pad portion. As will be seen from FIGS. 1, 8 and 9, the latch plate is open between the portions 83 and the adjacent latches 84 in the area below the cord passages 59 in the mounting bracket, to allow the traverse cords to pass downwardly therethrough.

The latch plate has latch means at its forward end arranged to releasably engage the pulley housing to retain it in preselected adjusted positions. For this purpose, the bottom wall 25 of each pulley housing is formed with a plurality of openings 85 at spaced locations therealong and the latch plate is formed with one or more upwardly extending latch dogs 86 (FIGS. 1 and 9) arranged to be received in a selected one of the openings 85. A pull tab 88 is formed on the under side of the latch plate and arranged to be grasped by the fingers of the user to pull the free end of the latch plate downwardly to release the latch dogs from the openings during adjustment of the pulley housing on the mounting bracket. Thus, the projection of the traverse rod from the wall can be easily adjusted by merely grasping the pull tab 88 to pull the distal end of the latch plate downwardly to a release position, and thereafter pushing the pulley housing either inwardly or outwardly to desired position. When the pull tab 88 is thereafter released, the latch will engage in a selected one of the openings 85 to latch the pulley housing in its adjusted position.

A drapery hook receiving eye or loop 91 is conveniently provided on the pulley housing to support a drapery adjacent the front wall of the pulley housing, and drapery receiving loops 93 are conveniently provided on both sides of the latch plate to support the drapery return at a location adjacent to the wall but forwardly of the cord guide passages 59, to facilitate access to the downwardly extending operating portions of the traverse cord.

From the foregoing it is thought that the construction and operation of the traverse rod and support assembly will be readily understood. The pulley housings have a removable cover to facilitate threading of the traverse cords over the cord guide pulleys and the mounting brackets also have a removable cover to facilitate threading of the traverse cords over the cord guides in the mounting bracket. The traverse cords can be guided rearwardly and downwardly at either end of the rod to locate the operating portions of the traverse cord at a selected end of the rod. When the pulley housing cover and mounting bracket cover are in position on the pulley housing and mounting bracket respectively, they form an effective enclosure for the pulley housing cord guides and the mounting bracket cord guides and for the portions of the traverse cord therebetween to provide a neat appearance and enclose the parts against entrance of dust and the like. The pulley housing can be readily adjusted relative to the mounting bracket without use of tools and the covers provide an enclosure in each of the different adjusted positions of the pulley housing.

Since various modifications of the illustrated embodiment herein shown will now be apparent to those skilled in the art, it is not intended to confine the invention to the precise form herein shown but rather to limit it only in terms of the appended claims.

The embodiments of the invention in which an exclusive property or privilege is claimed are defined as follows:

1. A drapery traverse rod and support assembly comprising, a traverse rod having a lengthwise extending trackway, master carrier means mounted for movement along the trackway, traverse cord means for moving the master carrier means along the trackway, at least one pulley housing, and a mounting bracket for mounting the pulley housing on a support surface, the pulley housing having a bottom wall and inner and outer side walls and a front wall, the pulley housing having an open area at a top side thereof and an open area at a rear side thereof and rod engaging means for supporting an end of the traverse rod with the rod extending transverse to the inner side wall of the pulley housing adjacent the front wall of the latter, the pulley housing having first cord guide means for guiding the traverse cord means fom the end of the rod rearwardly toward the mounting bracket, the mounting bracket having mounting pad means at a rear end thereof adapted for attachment to a support surface and pulley housing support means extending forwardly from the mounting pad means and adjustably received in the pulley housing through said open rear end thereof, the pulley housing support means having second cord guide means for guiding the traverse cord means downwardly adjacent said mounting pad means, a pulley housing cover detachably mounted on the pulley housing and overlying said first cord guide means, a mounting bracket cover detachably mounted on the mounting bracket and overlying the pulley housing support means, the mounting bracket cover being adapted to overlap the pulley housing cover to accommodate adjustment of the pulley housing relative to the mounting bracket.

2. A drapery traverse rod and support assembly according to claim 1 including interengaging means on the mounting bracket and pulley housing for releasably retaining the pulley housing in different adjusted positions on the pulley housing support means.

3. A drapery traverse rod and support assembly according to claim 1 including a latch plate attached to said mounting bracket and extending forwardly therefrom and underlying said pulley housing support means and at least a portion of the bottom wall of the pulley housing, and means on the latch plate engageable with the pulley housing for releasably latching the pulley housing in different adjusted positions on the pulley housing support means.

4. A drapery traverse rod and support assembly according to claim 1 wherein said first cord guide means comprises a pair of grooved pulleys mounted on the pulley housing for rotation about spaced upright axes, means for supporting the grooved pulleys at a preselected level above the bottom wall of the pulley housing, said second cord guide means comprising an open top cord guide channel in said pulley housing support means, said cord guide channel having a downwardly and rearwardly curved rear bottom wall portion spaced forwardly of said mounting pad means, the mounting bracket having a downwardly opening cord passage between the mounting pad portion and said bottom wall portion of the cord guide channel.

5. A drapery traverse rod and support assembly according to claim 4 including a divider panel integral with said support means and dividing said open top cord guide channel into two side-by-side cord receiving grooves, said divider panel extending rearwardly from said bottom wall portion and at least part way across said downwardly opening cord passage.

6. A drapery traverse rod and support assembly according to claim 4 wherein said pair of grooved pulleys are spaced apart at their peripheries a distance less than the thickness of the traverse cord means.

7. A drapery traverse rod and support assembly comprising, a traverse rod having a lengthwise extending trackway, master carrier means mounted for movement along the trackway, traverse cord means for moving the master carrier means along the trackway, a pulley housing at each end of the traverse rod, and a mounting bracket individual to each pulley housing, each pulley housing having a bottom wall and inner and outer side walls and a front wall, each pulley housing having an open area at a top side thereof and an open area at a rear side thereof and rod engaging means for supporting an end of the traverse rod with the traverse rod extending transverse to the inner side wall of the pulley housing adjacent the front wall of the latter, each mounting bracket comprising a rear mounting pad portion adapted for attachment to a supporting surface and pulley housing support arm means extending forwardly from the mounting pad portion and into the pulley housing through the open area at the rear side of the latter, means guidably mounting each pulley housing on the support arm means of the associated mounting bracket for adjustment therealong, a pair of grooved cord guide pulleys mounting on each pulley housing for rotation about spaced upright axes, each mounting bracket having open top cord guide channel means adapted to guide the traverse cord means downwardly adjacent the associated mounting pad means, a pulley housing cover detachably mounted on the pulley housing and overlying the pair of cord guide pulleys therein, and mounting bracket cover means detachably mounted on the mounting bracket and overing the open top cord guide channel means.

8. A drapery traverse rod and support assembly according to claim 7 wherein said open top cord guide channel means is formed in the pulley housing support arm means.

9. A drapery traverse rod and support assembly according to claim 7 wherein said support arm means includes a pair of support arms, said open top cord guide channel means being formed in each of the pair of support arms of each mounting bracket.

10. A drapery traverse rod and support assembly according to claim 7 including a latch plate attached to each mounting bracket and underlying the pulley support arm means and a portion of the bottom wall of the associated pulley housing, and interengaging means on the latch plate and pulley housing for releasably latching the pulley housing in preselected adjusted positions along the associated support arms.

11. A drapery traverse rod and support assembly according to claim 7 wherein cord guide channel means has a downwardly and rearwardly curved rear bottom wall portion spaced forwardly of said mounting pad means, each mounting bracket having a downwardly opening cord passage between the mounting pad portion and said rear bottom wall portion of the cord guide channel means.

12. A drapery traverse rod and support assembly according to claim 11 including, a divider panel extending upwardly from said bottom wall portion of the channel means and dividing the cord guide channel means into two cord receiving grooves, said divider panel extending rearwardly from said bottom wall portion and at least part way across said downwardly opening cord passage.

13. A drapery traverse rod and support assembly comprising a traverse rod having a lengthwise extending trackway, master carrier means mounted for movement along the trackway, traverse cord means for moving the master carrier means along the trackway, a pulley housing at each end of the traverse rod, and a mounting bracket individual to each pulley housing, each pulley housing having a bottom wall and inner and outer side walls and a front wall, each pulley housing having an open area at a top side thereof and an open area at a rear side thereof and rod engaging means for supporting an end of the traverse rod with the traverse rod extending transverse to the inner side wall adjacent the front wall of the pulley housing, each mounting bracket including a rear mounting pad portion adapted for attachment to a supporting surface and arm means extending forwardly from the mounting pad portion and into the pulley housing through the open area of the rear side of the pulley housing, means guidably mounting each pulley housing on the support arm means of the associated mounting bracket for adjustment therealong, a first cord guide means on each pulley housing for guiding the traverse cord means to and from the rod, a second cord guide means on each mounting bracket for guiding the traverse cord means downwardly adjacent the associated mounting pad portion, a latch plate having a rear end mounted on the mounting pad portion of each mounting bracket and extending forwardly therefrom and underlying the support arm means and at least a portion of the bottom wall of the associated pulley housing, and interengaging means on each latch plate and the associated pulley housing for releasably latching the pulley housing in different adjusted positions on the support arm means.

14. A drapery traverse rod and support assembly according to claim 13 wherein each latch plate has latch means adjacent a forward end thereof and finger pull tab extending downwardly adjacent said forward end to facilitate manually pulling the forward end of the latch plate downwardly to release the latch means.

15. A drapery traverse rod and support assembly according to claim 13 including a pulley housing-cover detachably mounted on each pulley housing and overlying the first cord guide means.

16. A drapery traverse rod and support assembly according to claim 13 including a mounting bracket cover detachably mounted on each mounting bracket and overlying the associated support arm means.

17. A drapery traverse rod and support assembly according to claim 13 including pulley housing cover detachably mounted on each pulley housing and overlying the first cord guide means, and a mounting bracket cover detachably mounted at a rear end thereof on the mounting pad portion of each mounting bracket, each mounting bracket cover extending forwardly in overlying relation to the associated support arm means and overlapping a portion of the cover on the associated pulley housing.

* * * * *

UNITED STATES PATENT AND TRADEMARK OFFICE

CERTIFICATE OF CORRECTION

PATENT NO. : 4,785,866

DATED : November 22, 1988

INVENTOR(S) : Ronald G. Darner

It is certified that error appears in the above-identified patent and that said Letters Patent are hereby corrected as shown below:

Claim 7, column 10, line 2, delete "overing" and insert -- overlying --;

Claim 13, column 10, line 38, insert -- , -- after "comprising".

Signed and Sealed this

Twenty-eighth Day of March, 1989

*Attest:*

DONALD J. QUIGG

*Attesting Officer*

*Commissioner of Patents and Trademarks*